US006109719A

United States Patent [19]

Cornell

[11] Patent Number: 6,109,719

[45] Date of Patent: Aug. 29, 2000

[54] PRINTHEAD THERMAL COMPENSATION METHOD AND APPARATUS

[75] Inventor: Robert Wilson Cornell, Lexington, Ky.

[73] Assignee: Lexmark International, Inc., Lexington, Ky.

[21] Appl. No.: 09/089,714

[22] Filed: Jun. 3, 1998

[51] Int. Cl.[7] ..... B41J 2/07; B41J 2/205; B41J 2/375

[52] U.S. Cl. ..... 347/14; 347/223

[58] Field of Search ..... 347/14, 56, 57, 347/223

[56] References Cited

U.S. PATENT DOCUMENTS

| | | | |
|---|---|---|---|
| 4,908,638 | 3/1990 | Albosta et al. | 346/140 R |
| 4,950,365 | 8/1990 | Evans | 204/38.7 |
| 4,960,050 | 10/1990 | Hatch | 101/348 |
| 4,977,410 | 12/1990 | Onuki et al. . | |
| 5,036,337 | 7/1991 | Rezanka | 346/1.1 |
| 5,053,792 | 10/1991 | Une | 346/146 |
| 5,343,231 | 8/1994 | Suzuki | 347/14 |
| 5,367,325 | 11/1994 | Yano et al. | 347/17 |
| 5,426,458 | 6/1995 | Wenzel et al. | 347/45 |
| 5,519,429 | 5/1996 | Zwijsen et al. | 347/223 |
| 5,538,758 | 7/1996 | Beach et al. | 427/255.6 |
| 5,784,666 | 7/1998 | Nagase et al. | 399/44 |
| 5,894,314 | 4/1999 | Tajika et al. | 347/14 |

*Primary Examiner*—John S. Hilten
*Assistant Examiner*—Amanda B Sandusky
*Attorney, Agent, or Firm*—Michael T. Sanderson; Luedeka, Neely & Graham

[57] ABSTRACT

The invention described in the specification relates to an apparatus and method for cooling a printhead containing multiple semiconductor substrates. The substrates which contain a plurality of energy imparting devices for energizing ink are attached to a metal substrate carrier for providing efficient heat transfer from the substrates. A temperature sensing device is attached to the carrier for measuring a temperature of the substrate carrier during a printing operation and for generating an input signal to a controller. The controller, in turn, sends an output signal to the printhead to selectively energize one or more of the energy imparting devices on each substrate in response to the input signal and a thermal expansion value based on the temperature of the heat transfer member. Because the timing of energization of the energy imparting devices is controlled in response to the carrier temperature and its expansion characteristics, more cost effective materials for the carrier can be used.

22 Claims, 4 Drawing Sheets

PRINTHEAD THERMAL COMPENSATION METHOD AND APPARATUS

FIELD OF THE INVENTION

The invention relates a printhead structure for heat removal from a thermal ink jet printhead and a method for thermal compensation of the printhead to improve print quality.

BACKGROUND OF THE INVENTION

Thermal ink jet printers use printheads containing heating elements on a semiconductor substrate for heating ink so that the ink is imparted with sufficient energy to cause the ink to be ejected through a nozzle hole in a nozzle plate attached adjacent to the substrate. The nozzle plate typically consists of a plurality of spaced nozzle holes which cooperate with individual heater elements on the substrate to eject ink from the printhead toward the print media. The number, spacing and size of the nozzle holes influences the print quality. Increasing the number of nozzle holes on a printhead typically increases the print speed without necessarily sacrificing print quality provided the ink is ejected at precisely the correct spot onto the media. However, there is a practical limit to nozzle hole or orifice size and to the size of the semiconductor substrate which can be produced economically in high yield. Thus, there is a practical limit to the number of corresponding nozzle holes which can be provided in a nozzle plate for a printhead.

For color printing applications, the three primary colors of cyan, magenta and yellow are used to create a pallet of colors. Typically, each color is associated with a nozzle plate and semiconductor substrate specifically designed or tuned to give optimal performance with the associated color. Such nozzle plates are typically attached to separate printheads so that the number of nozzle holes per color is maximized for high quality, high speed printing. However, it is extremely difficult to maintain an alignment tolerance of a few microns between the printheads when using separate printheads.

Using a single substrate containing separate heating elements for each color reduces the alignment problem associated with using separate printheads but reduces the number of nozzle holes and thus the print speed because of the practical limit to substrate size. In order to obtain suitable substrate production yields, the substrates or chips cannot be large enough to contain the same number of energy imparting devices as would be located on individual substrates attached to separate printhheads.

While locating multiple individual substrates of a conventional size on the same printhead allows relatively faster printing rates, such a design contributes to significantly increasing the printhead temperature because of the greater number of energy imparting devices located on the printhead and the desire to eject the ink from the printhead at a faster rate. The increased printhead temperature causes changes in the printhead dimensions making it difficult to maintain the spacing between multiple chips on the printhead thus adversely affecting print quality.

Various materials and methods have been proposed for removing heat from the printhead substrates. Conventionally, materials which exhibit a low thermal expansion coefficient have been used to provide suitable heat removal without sacrificing print quality. Materials having low thermal expansion coefficients do not typically expand or contract a sufficient amount to affect printer operation and thus print quality. These materials enable printhead designs that are tolerant of temperature variations since expansion and/or contraction of the components and electrical connections therebetween is minimized. However, such materials are typically made from exotic composite materials such as metal-ceramic mixtures, carbon fiber, or graphite composites which are costly to make and use in such applications.

Accordingly, an object of the invention is to provide a cost effective material for heat removal from printhead substrates without sacrificing print quality.

Another object of the invention is to provide a method for improving print quality in a multi-color printhead.

A further object is to provide a multi-color printhead for thermal ink jet printer which provides improved print quality at a relatively lower cost than conventional printheads.

A still further object of the invention is to provide a printhead and associated method which enables compensation for dimensional changes of the printhead so that print quality is not adversely affected by such dimensional changes.

SUMMARY OF THE INVENTION

With regard to the above and other advantages, the invention provides an ink jet printhead containing two or more spatially separate semiconductor substrates mounted in side-by-side relationship on a metal heat transfer member, each substrate contains a plurality of energy imparting devices for energizing ink, a temperature sensing device adjacent to the printhead for measuring a temperature of the heat transfer member during a printing operation and for generating an input signal to a controller wherein the controller sends an output signal to the printhead to selectively energize one or more of the resistive elements on each substrate in response to the input signal and a thermal expansion value based on the temperature of the heat transfer member.

In another aspect, the invention provides a method for improving print quality of a multi-color thermal ink jet printer which comprises mounting two or more semiconductor substrates containing a plurality of resistive elements in side-by-side relationship in spatially separate locations on a metal substrate carrier, positioning the substrate carrier to an adjacent ink cartridge for supplying ink to the substrates, providing a temperature sensing device for outputting a signal corresponding to the temperature of the substrate carrier, providing a controller having a timing program for receiving output signals from the temperature sensing device and generating control signals in response thereto, said control signal being generated by the controller as a function of time and being based upon temperature information received from the temperature sensing device and predetermined thermal expansion information for the metal substrate carrier and said resistive elements being responsive to the control signals so that during a printing operating, one or more of the resistive elements on each substrate is selectively energized in response to the control signal.

Yet another aspect of the invention provides a method for making a printhead for a thermal ink jet printer which comprises providing a metal substrate carrier, mounting two or more semiconductor substrates on the carrier in spatially separate locations in a side-by-side relationship, wherein each substrate contains a plurality of energy imparting devices for ink, attaching a temperature sensing device to the carrier, connecting the temperature sensing device to a controller through an input line, which controller provides an output signal to the one or more energy imparting devices said signal being responsive to the temperature of the carrier and a thermal expansion value for the carrier.

The apparatus and method of the invention provide for the use of cost effective materials for construction of ink jet printheads while assuring relatively precise ink droplet placement during printing operations. Accordingly, rather than attempting to reduce thermal expansion by selecting exotic components for use in fabricating printheads, materials having relatively high coefficients of thermal expansion may be used. Such materials also typically possess relatively high thermal conductivities, accordingly, such materials may be used to provide an effective heat transfer medium for cooling the printhead components. Cooling of the printhead components is particularly important for printheads containing multiple substrates, with the increase in the number of energy imparting devices on each substrate and with the increased firing speed of the energy imparting devices.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1A:
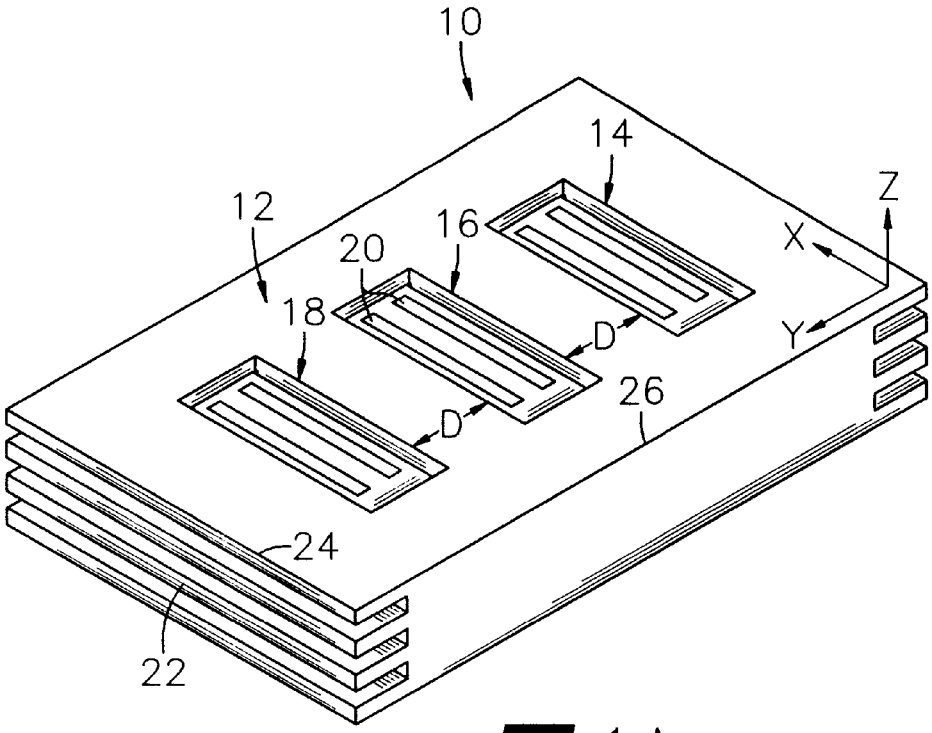
FIGS. 1A and 1B are top and bottom perspective views, respectively, of a carrier material according to the invention showing the x, y, and z coordinates of the material.
Figure 1B:
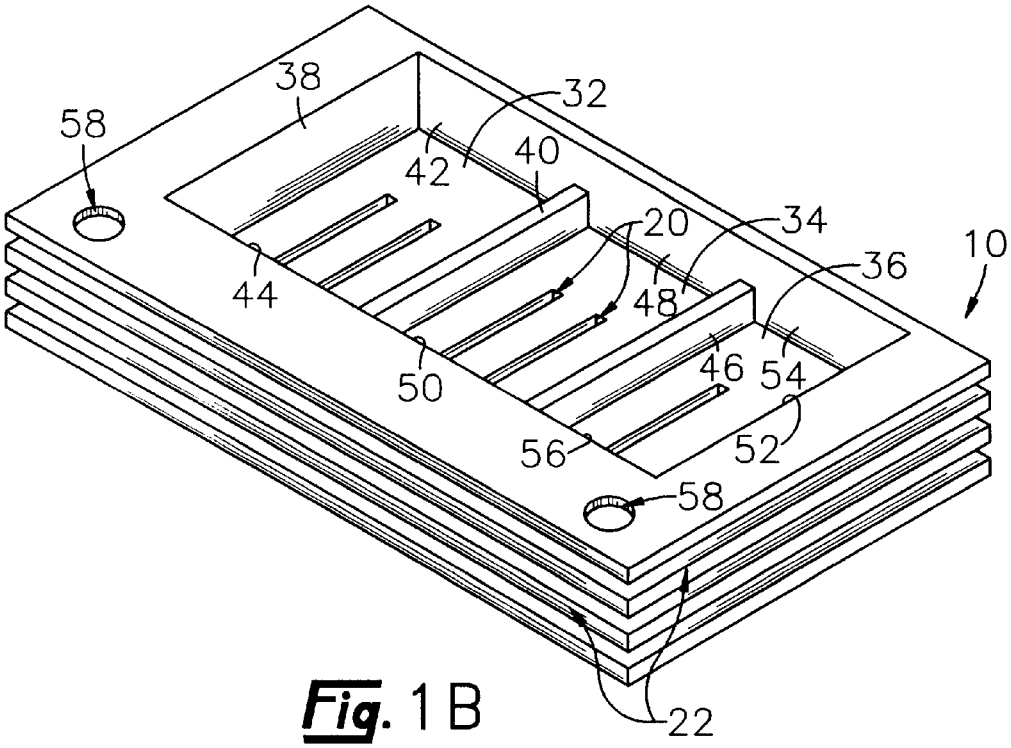

With reference now to FIGS. 1A and 1B there is shown, in perspective views, a substrate carrier 10 according to the invention. The substrate carrier is made of a metal material having relatively high thermal conductivity and a relatively constant coefficient of thermal expansion so that dimensional changes along the x and y axes defined by a plane parallel to surface 12 of the carrier 10 are substantially predictable over a wide temperature range, such as between about 5° C. and about 65° C., which is the temperature range normally experienced by the printhead substrates of thermal ink jet printers.

The carrier 10 contains one or more substrate locators, pockets or wells 14, 16 and 18 which define the location of one or more semiconductor substrate chips which are located adjacent to and preferably attached to the carrier. Each pocket 14, 16 and 18 contains apertures 20 in the bottom or base thereof which allow ink from an ink reservoir to flow to the energy imparting areas of the chips or substrates. The energy imparting areas of the chips may be provided as by resistive or heating elements which heat the ink or by piezoelectric devices of the type which induce pressure pulses to the ink in response to a signal from a printer controller.

As shown, the carrier 10 is preferably a shaped, molded or machined metal device which may contain cooling fins 22 along one or more sides 24 thereof for convective cooling of the carrier 10. For convenience, x, y and z coordinate axes are positioned relative to the carrier 10 so that the x axis is parallel to side 24, the y axis is parallel to side 26 and the z axis is perpendicular to planar surface 12 defined by sides 24 and 26.

As shown in FIG. 1B, each pocket 14, 16 or 18 is associated with a chamber 32, 34 or 36. Chamber 32 is defined by side wall 38, partition wall 40 and end walls 42 and 44. Chamber 34 is defined by partition walls 40 and 46 and end walls 48 and 50. And chamber 36 is defined by partition 46, side wall 52 and end walls 54 and 56.

As the carrier 10 heats or cools, the distance D between pockets 14, 16 and 18 changes in proportion to the coefficient of thermal expansion of the carrier metal along the y axis relative to a plane parallel to the surface 12 of the carrier 10. The pocket may also change or shift along the x axis as the carrier heats or cools. An expansion or contraction value for the carrier in the x and y directions is determined for the carrier metal based on the thermal expansion coefficient for the metal and this value is input to a printer controller. The printer controller uses the input value to adjust the timing of ink ejection from one or more of the nozzle holes associated with the substrates as described in more detail below.

An improved printhead according to the invention includes carrier 10 attached to an ink cartridge which supplies ink to chambers 32, 34 and 36 of the carrier 10. In order to control the exact location of the ink drop placement on a substrate, the carrier is mounted to an ink cartridge using alignment marks or devices on the carrier and/or cartridge. As shown in FIG. 1B, carrier 10 is provided with alignment holes, slots or marks 58 which provide essentially accurate placement of the carrier on the ink cartridge by aligning the holes, slots or marks 58 with corresponding marks or projections on the cartridge body. Other projections, marks or slots may be used to align the carrier and cartridge body.

Figure 2:
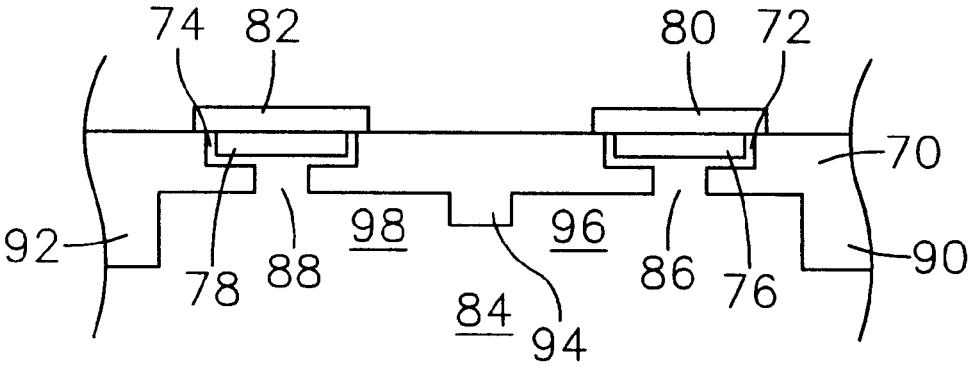
FIG. 2 is a cross-sectional view from one end of a printhead structure according to the invention showing multiple chips or substrates attached thereto.

Referring now to FIG. 2, there is shown in cross-section, a carrier 70 containing pockets 72 and 74 for receiving semiconductor substrates or chips 76 and 78. Nozzle plates 80 and 82 are attached to the substrates or chips 76 and 78. Ink is provided from an ink reservoir 84 through apertures or channels 86 and 88 in carrier 70 to the substrates 76 and 78 so that when energized, the ink flows through apertures in nozzle plates 80 and 82 to a media to be printed.

As shown in FIG. 2, ink supply chambers 96 and 98 are provided in the carrier 70 to provide ink to the individual substrates or chips 76 and 78 attached to the carrier through channels 86 and 88. For a carrier containing only two chips, the ink chambers 96 and 98 are defined by end walls 90 and 92 and partition wall 94.

Figure 3:
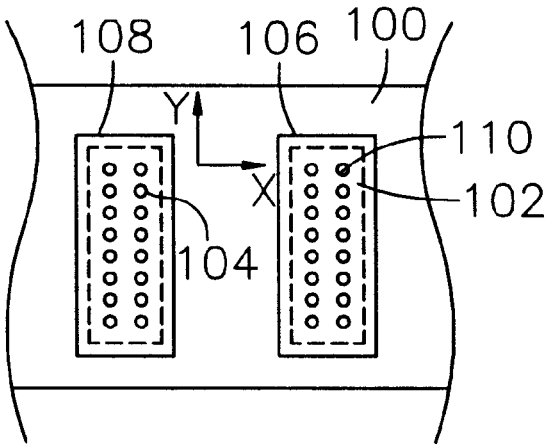
FIG. 3 is a top plan view, showing a printhead structure according to the invention showing multiple nozzle plates attached to the structure.
Figure 4:
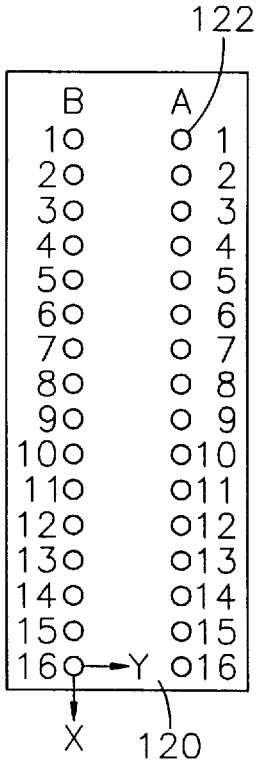
FIG. 4 is a top plan view showing a nozzle plate having nozzle holes identified by location thereon.

FIG. 3 is a top plan view of a carrier 100 containing pockets 102 and 104 and nozzle plates 106 and 108 over semiconductors substrates or chips positioned in the pockets 102 and 104. The nozzle plates 106 and 108 contain a plurality of nozzle holes or apertures 110 which direct ink from the energy imparting devices on the chips through the apertures to a media to be printed. The nozzle holes 110 have an across dimension (such as a diameter for circular holes) on the print media side thereof ranging from about 10 to about 30 microns and each nozzle plate 102 and 104 may contain 50 to 100 nozzle holes or more. In this regard, it will be understood that the nozzle holes may be circular or square or of various other geometry.

Because of the small size of the nozzle holes 110, any slight misalignment of a hole through which ink is being ejected with a print media can have a significant impact on the quality of the printed image. It has been experienced that the location of each nozzle holes may move in the x and y directions during printer operation relative to their locations when the printer is not in use in response to the expansion and/or contraction of the carrier 100. Knowing the temperature of the carrier 100, it is possible to accurately predict the location of an individual nozzle hole using a coefficient of thermal expansion of the carrier material.

A preferred material for the carrier 10 (FIG. 1A ) is a material having a relatively high thermal conductivity and a relatively constant coefficient of thermal expansion over a range of temperatures from 5° to about 65° C. Such materials should exhibit a relatively constant dimensional change at least with respect to a plane parallel to the surface of the carrier. Because the carrier is relatively thin compared to its length and width, the thermal expansion of the carrier in a direction normal to the surface of the carrier is less critical and need not be used for the purposes of this invention.

By "relatively high thermal conductivity" means material having a thermal conductivity above about 50 watts/(meter–° C.). By "relatively constant coefficient of thermal expansion means" that coefficient of thermal expansion of the metal is essentially unchanged over a temperature range of from about to about 5° to about 65°.

Figure 5:
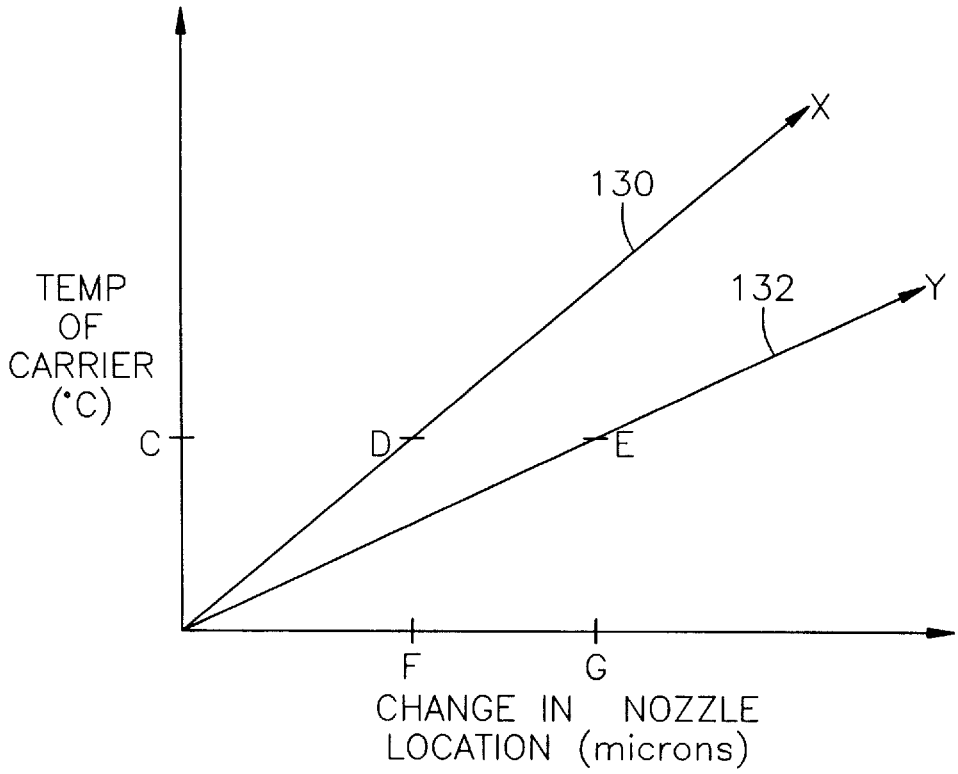
FIG. 5 is a graphical representation showing expansion and contraction of a chip carrier of the invention for a given temperature thereof.

For a metal with the foregoing properties and given the temperature of the material, the change in nozzle location along the x and y axes can be predicted as shown in FIG. 5 by lines 130 and 132. For example, at a temperature of C, the distance the nozzle hole is displaced along the x axis is F microns corresponding to point D on line 130 and along the y axis is G microns corresponding to point E on line 132. Data points, D and E are calculated by equation I, II, III and IV:

$$\Delta)x=(f)k(\Delta/T) \quad \text{(I)}$$

$$\Delta)y=(f)k(\Delta/T) \quad \text{(II)}$$

$$D=x_0+\Delta/x \quad \text{(III)}$$

and $$E=y_0+\Delta/y \quad \text{(IV)}$$

wherein $\Delta/x$ and $\Delta/y$ represent the change in print nozzle locations in microns relative to initial print nozzle location $x_0$ and $y_0$, k is the coefficient of thermal expansion of the carrier material, $\Delta/T$ is the change in temperature of the carrier material in ° C. relative to an initial temperature and (f) is a functional relationship between the temperature change and the change in nozzle location.

Metals or metal-based materials having a relatively high thermal conductivity and relatively constant coefficient of linear expansion such as aluminum, beryllium, copper, gold, silver, zinc, magnesium and the like may be used as the carrier material. A particularly preferred carrier material is an aluminum-based metal. By the term "aluminum-based" refers to aluminum and metal alloys which are substantially aluminum, i.e., more than 90 wt. % aluminum.

Once the change in nozzle location is determined, the timing of the energization of the energy imparting devices for selected nozzles is changed so that the ink is ejected at precisely the spot desired as the cartridge and paper are moving relative to each other. A simplified flow diagram for the process of energizing the nozzles in response to the carrier temperature is given in FIG. 6.

Figure 6:
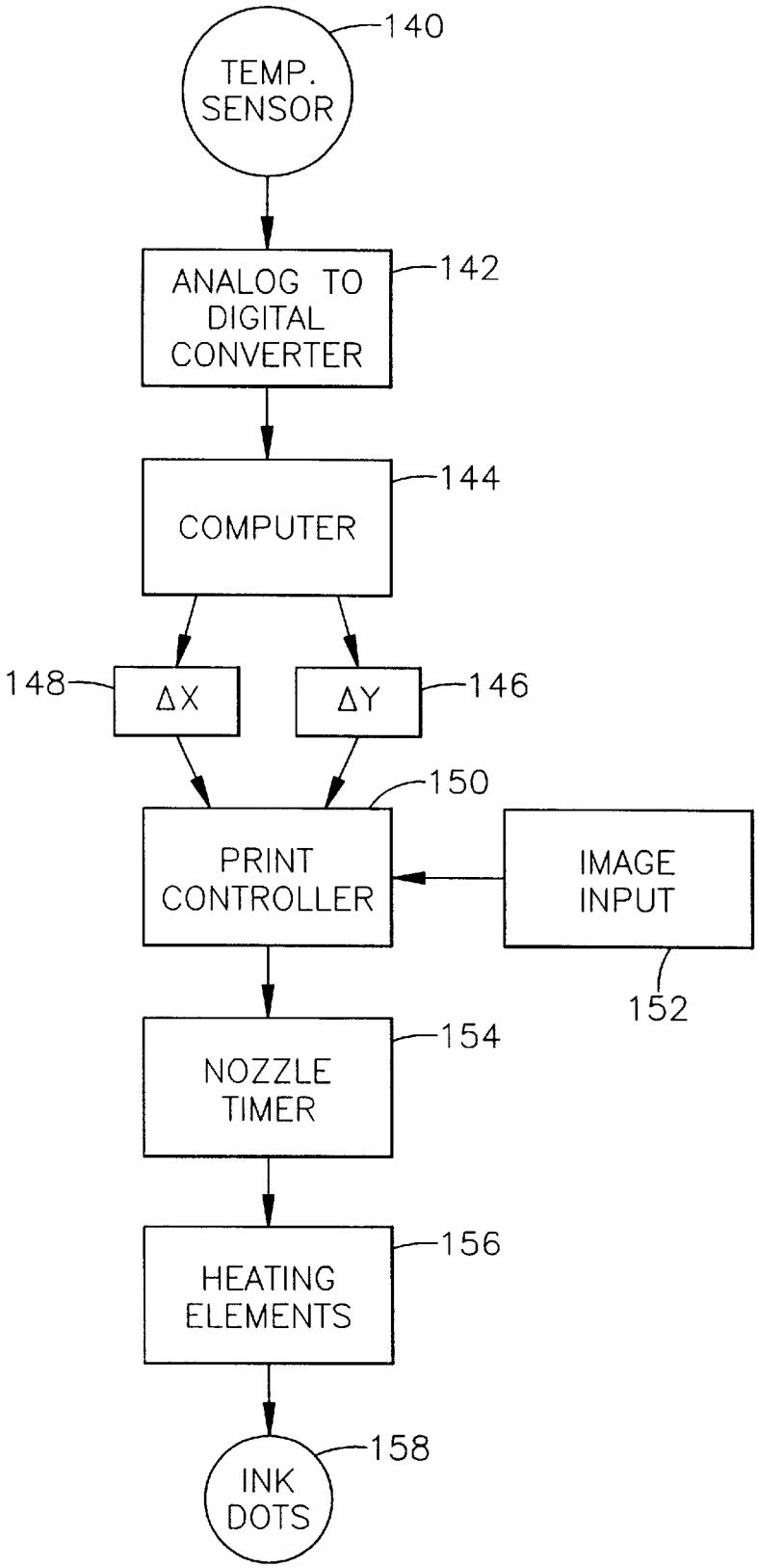
FIG. 6 is a block flow diagram for selection of a firing location based on an expansion or contraction distance obtained as from a graph such as the graph of FIG. 5.

As shown in FIG. 6, a temperature sensor 140 provide an analog signal which is converted to a digital signal by analog to digital converter 142. In the alternative, the temperature sensor 140 may be deposited directly on the silicon substrate itself instead of being attached as a separate component to the carrier. The digital signal is input to a computing device 144 located in the printer. The computing device calculates the relative change in nozzle position along the x and y axes based on a function of the thermal expansion coefficient of the carrier material and output signals corresponding to the values designated by boxes 146 and 148 to a printer controller 150. The printer controller 150 analyzes the image input signal from input device 152 and provides an output signal to a nozzle timing device 154. The nozzle timing device 154 energizes selected energy imparting devices 156 so that ink is ejected in a desired pattern 158 at the desired location on a print media.

In order to reduce corrosion of the carrier caused by components in the ink, it is preferred to coat the carrier with a corrosion resistant material. The coating thickness should be minimized in order to maximize conductive heat transfer from the substrates to the carrier and to maximize convective heat transfer from the carrier to the surrounding atmosphere. A coating thickness of ranging from about 1 to about 10 microns is preferred.

A particularly preferred coating material is a poly (xylelene) which is available from Specialty Coating Systems of Indianapolis, Ind. under the tradename PARYLENE which polymerizes out of a vapor phase onto the carrier. A description of poly(xylelenes), the processes for making these compounds and the apparatus and coating methods for using the compounds can be found in U.S. Pat. Nos. 3,246,627 and 3,301,707 to Loeb, et al. and U.S. Pat. No. 3,600,216 to Stewart, all of which are incorporated herein by reference as if fully set forth.

Another preferred coating which may be used to protect a metal carrier or metal composite carrier is silicon dioxide in a glassy or crystalline form. An advantage of the silicon dioxide coating over a poly(xylelene) coating is that silicon dioxide has a higher thermal conductivity than poly (xylelenes) and thus a greater coating thickness can be used. Another advantage of silicon dioxide is that it provides a surface having high surface energy thus increasing the adhesiveness of glues or adhesives to the coated surface. The coating thickness of the silicon dioxide ranges from 0.2 about to about 12 microns or more.

A carrier may be coated with silicon dioxide by a spin on glass (SOG) process using a polymeric solution available from Allied Signal, Advanced Materials Division of Milpitas, California under the tradename ACCUGLASS T-14. This material is a siloxane polymer that contains methyl groups bonded to the silicon atoms of the Si-O polymeric backbone. A process for applying a SOG coating to a substrate is described, for example, in U.S. Pat. No. 5,290,399 Reinhardt and U.S. Pat. No. 5,549,786 to Jones et al. incorporated herein by reference as if fully set forth.

The carrier may also be coated with silicon dioxide using a metal organic deposition (MOD) ink which is available from Engelhard Corporation of Jersey City, N.J. The MOD ink is available as a solution in an organic solvent. The MOD process is generally described in U.S. Pat. No. 4,918,051 to Mantese et al. In addition to the foregoing, the silicon dioxide may be applied to the carrier from an SOG or MOD solution using a dipping, spraying, brushing or other process. After coating the carrier, the coating is dried and fired to burn off the organic component leaving silicon that reacts with oxygen to form silicon dioxide or other metal silicates on the surface of the carrier.

Regardless of the coating and coating technique used, it is preferred to use a coating and coating process which provides a layer of the coating having a thickness that is substantially uniform over the entire carrier and which does not adversely affect heat transfer to the carrier from the semiconductor substrates. The coating should be adaptable to intricate shapes and features of the carrier so that there is essentially no uncoated surface of the carrier.

Accordingly, it will be appreciated that a significant advantage of the invention results from the ability to utilize relatively inexpensive materials of the type commonly avoided for such applications because of their tendencies to significantly change dimension in response to changes in temperature. This ability is achieved by the invention by providing structure and a method for compensating for the dimensional changes so that such changes do not adversely affect the printing process.

Having described various aspects and embodiments of the invention and several advantages thereof, it will be recognized that the invention by those of ordinary skills susceptible to various modifications, substitutions and revisions within the spirit and scope of the appended claims.

What is claimed is:

1. An ink jet printhead containing two or more spatially separate semiconductor substrates and a metal heat transfer member, said substrates being mounted in side-by-side relationship on said metal heat transfer member, each substrate containing a plurality of energy imparting devices for energizing ink, a temperature sensing device adjacent to the printhead for measuring a temperature of the heat transfer member during a printing operation and for generating an input signal to a controller, the controller sending an output signal to the printhead to selectively energize one or more of the energy imparting devices on each substrate in response to the input signal, said controller output signal substantially compensating for nozzle displacement along x and y axes relative to initial nozzle locations as a function of thermal expansion of the heat transfer member based on the temperature.

2. The printhead of claim 1 containing at least three semiconductor substrates.

3. The printhead of claim 1 wherein the heat transfer member comprises a metal selected from the group consisting of aluminum, beryllium, copper, gold, silver, magnesium and zinc.

4. The printhead of claim 1 wherein the energy imparting devices comprise resistive elements.

5. The printhead of claim 1 wherein the heat transfer member contains cooling fins.

6. The printhead of claim 1 wherein the heat transfer member contains substrate pockets for attaching the substrates to the heat transfer member.

7. The printhead of claim 1 wherein the heat transfer member contains alignment holes, slots or marks for aligning the heat transfer member with a printer cartridge to which it is attached.

8. A method for improving print quality of a multi-color thermal ink jet printer which comprises mounting two or more semiconductor substrates containing a plurality of resistive elements in side-by-side relationship in spatially separate locations on a metal heat transfer member, attaching the heat transfer member to an ink cartridge for supplying ink to the substrates, attaching a temperature sensing device to the heat transfer member, connecting the temperature sensing device to a controller, inputting a signal generated by the temperature sensing device to the controller responsive to a temperature of the heat transfer member during a printing operating, outputting a signal from the controller to the substrates to selectively energize one or more of the resistive elements on each substrate in response to the input signal, the controller output signal substantially compensating for nozzle displacement along x and y axes relative to initial nozzle locations as a function of thermal expansion of the heat transfer member based on the temperature.

9. The method of claim 8 wherein the metal substrate carrier contains at least three semiconductor substrates.

10. The method of claim 8 wherein the metal substrate carrier comprises a metal selected from the group consisting of aluminum, beryllium, copper, gold, silver, magnesium and zinc.

11. The method of claim 8 wherein the metal substrate carrier contains cooling fins.

12. The method of claim 8 wherein the metal substrate carrier contains substrate pockets for attaching the substrates to the carrier.

13. The method of claim 8 wherein the metal substrate carrier contains alignment holes, slots or marks for aligning the substrate carrier with a printer cartridge to which it is attached.

14. The method of claim 8 further comprising an analog to digital converter for converting an analog signal from the temperature sensing device to a digital signal and inputting the digital signal to the controller to control energization of the resistive elements.

15. The method of claim 8 wherein the resistive elements are selectively energized so that ejection of ink onto a print media is timed to coincide with a particular location on the print media as the ink cartridge and print media move relative to one another during a printing operation.

16. A method for making a printhead for a thermal ink jet printer which comprises providing a metal heat transfer member, mounting two or more semiconductor substrates on the heat transfer member in spatially separate locations in side-by-side relationship, wherein each substrate contains a plurality of energy imparting devices for ink, attaching a temperature sensing device to the heat transfer member, connecting the temperature sensing device to a controller through an input line, which controller, in turn, provides an output signal to the one or more energy imparting devices, said controller output signal being responsive to the temperature of the heat transfer member and substantially compensating for nozzle displacement along x and y axes relative to initial nozzle locations as a function of thermal expansion of the heat transfer member based on temperature.

17. The method of claim 16 wherein the substrate carrier contains at least three semiconductor substrates.

18. The method of claim 16 wherein the substrate carrier is comprised of a metal selected from the group consisting of aluminum, beryllium, copper, gold, silver, magnesium and zinc.

19. The method of claim 16 wherein the energy imparting devices comprise resistive elements.

20. The method of claim 16 wherein the substrate carrier contains cooling fins.

21. The method of claim 16 wherein the substrate carrier contains substrate pockets for attaching the substrates to the carrier.

22. The method of claim 16 wherein the substrate carrier contains alignment holes, slots or marks for aligning the substrate carrier with a printer cartridge to which it is attached.

* * * * *